US006418294B2

(12) United States Patent
Morikami et al.

(10) Patent No.: US 6,418,294 B2
(45) Date of Patent: Jul. 9, 2002

(54) COLOR IMAGE FORMING APPARATUS WITH INTERMEDIATE TRANSFER MEMBER LENGTH A NON-INTEGRAL MULTIPLE OF IMAGE PITCH

(75) Inventors: Yuusuke Morikami, Toyohashi; Seiichi Munemori; Takanobu Yamada, both of Toyokawa, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/884,141

(22) Filed: Jun. 20, 2001

(30) Foreign Application Priority Data

Jul. 3, 2000 (JP) ..... 2000-200897

(51) Int. Cl.[7] ..... G03G 15/01
(52) U.S. Cl. ..... 399/298; 399/302
(58) Field of Search ..... 399/298, 302, 399/308, 75, 76; 347/115

(56) References Cited

U.S. PATENT DOCUMENTS 4,899,196 A * 2/1990 Mahoney ..... 399/302
5,287,160 A 2/1994 Dastin et al.
5,802,422 A 9/1998 Hokari
5,946,525 A 8/1999 Okamura et al.
6,029,033 A 2/2000 Kawasaki
6,049,350 A 4/2000 Yamaguchi
6,061,542 A 5/2000 Minami et al.
6,094,551 A * 7/2000 Nakamura et al. ..... 347/115

FOREIGN PATENT DOCUMENTS

JP 7-28294 1/1995

* cited by examiner

*Primary Examiner*—Joan Pendegrass
(74) *Attorney, Agent, or Firm*—Morrison & Foerster, LLP

(57) ABSTRACT

A color image forming apparatus of the present invention has an intermediate transfer member having a movable surface, a plural image forming units for forming superposed toner images on the intermediate transfer member at a predetermined image forming pitch, and a transfer member for transferring the superposed toner images formed on the intermediate transfer member onto a sheet of paper, wherein the peripheral length of the intermediate transfer member is a non-integral multiple of the image forming pitch.

20 Claims, 3 Drawing Sheets

COLOR IMAGE FORMING APPARATUS WITH INTERMEDIATE TRANSFER MEMBER LENGTH A NON-INTEGRAL MULTIPLE OF IMAGE PITCH

RELATED APPLICATION

The present invention is based on Japanese Patent Application No. 2000-200897, the content of which is hereby incorporated by reference.

BACKGROUND OF THE INVENTION

1. Field of the Invention

The present invention relates to a so-called tandem-type color image forming apparatus.

2. Description of the Related Art

So-called tandem-type color image forming apparatuses are conventionally known to have a plurality of image forming units containing toner of different colors arranged along an intermediate transfer belt as disclosed, for example, in Japanese Laid-Open Patent No. H7-28294.

In this type image forming apparatus, image forming units form an image on an intermediate transfer belt, and this formed image is printed on a sheet of a size desired by a user. The intermediate transfer belt comprises conductive carbon particles dispersed in resin so as to have semi conductivity.

When images are formed in the same range of the intermediate transfer belt and transferred to paper many times, the degree of dispersion (dispersion state) of the carbon particles in this range changes such that the resistance value and surface condition of the intermediate transfer belt changes in the area between the image area of repeated electrical current flow and the image area without electrical current flow. Image drift may be generated when an image is formed in the intermediate transfer belt range including the border location of the condition-changed areas.

SUMMARY OF THE INVENTION

An object of the present invention is to provide an image forming apparatus which prevents image drift due to change-of-state of the intermediate transfer member.

The color image forming apparatus of the present invention comprises an intermediate transfer member having a movable surface, a plural image forming units for forming superposed toner images on the intermediate transfer member at a predetermined image forming pitch, and a transfer member for transferring the superposed toner images formed on the intermediate transfer member onto a sheet of paper, wherein the peripheral length of the intermediate transfer member is a non-integral multiple of the image forming pitch.

In the image forming apparatus of the present invention, since the length of the intermediate transfer member is a non-integral multiple of the image forming pitch, the image forming range on the intermediate transfer member formed at a predetermined image forming pitch by each image forming unit shifts with each single rotation of the intermediate transfer member. In this way the image forming range can be dispersed on the intermediate transfer member, the range of the state-changed part of the intermediate transfer member caused by repeated image formation in the same range of the intermediate transfer member can be dispersed, and image drift on the sheet to which the image is transferred can be prevented. The state-change of the intermediate transfer member is the change of the surface condition and the resistance vale of the intermediate transfer member. The image forming pitch is desirably a length that matches the maximum sheet length and image interval distance. Furthermore, the intermediate transfer member desirably has semi conductivity.

BRIEF DESCRIPTION OF THE DRAWINGS

FIG. 2(*b*) shows the state of an image I2 formed on the intermediate transfer belt;

FIG. 3(*b*) shows the state of an image I4 formed on the intermediate transfer belt.

DESCRIPTION OF THE PREFERRED EMBODIMENTS

Figure 1:
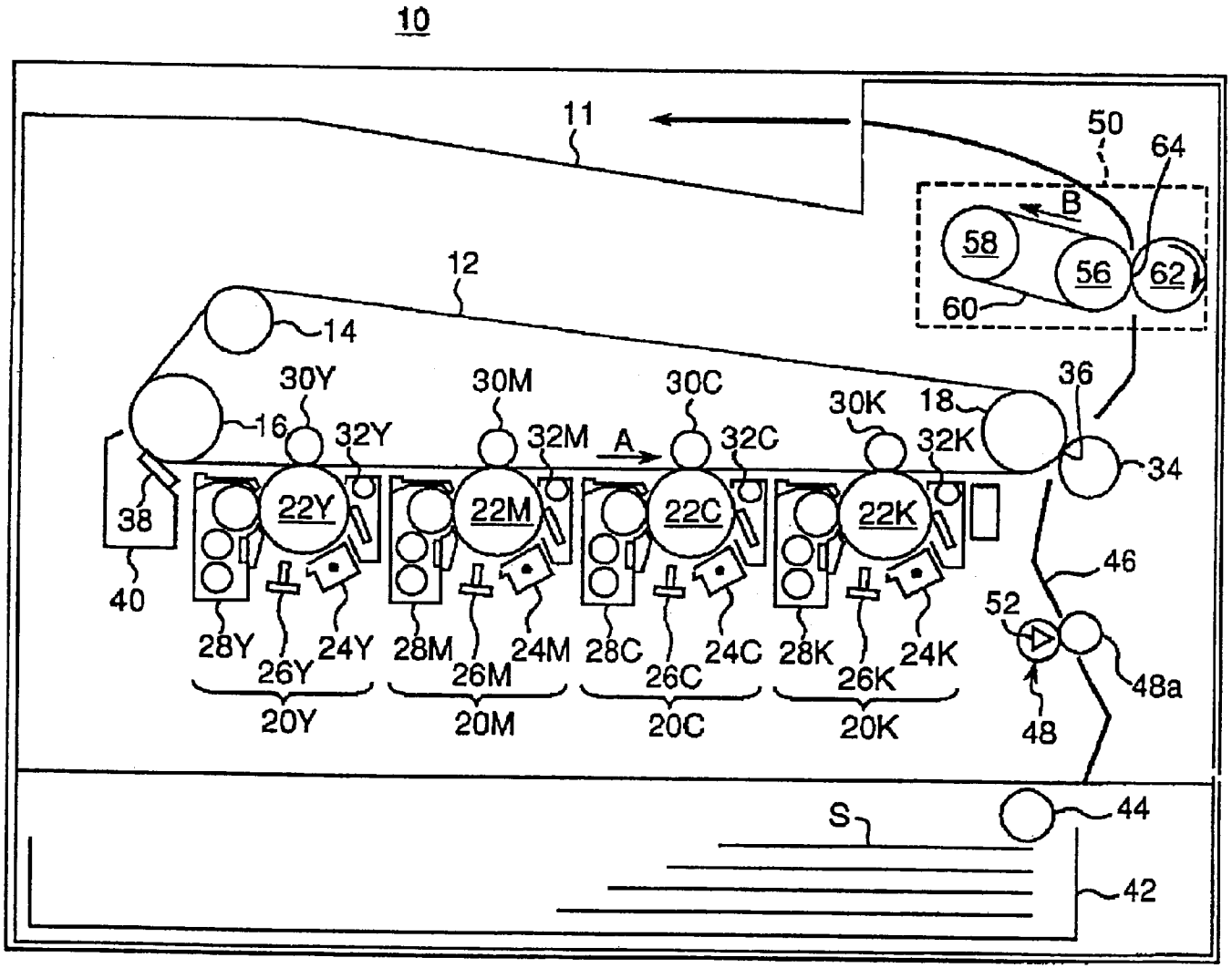
FIG. 1 shows the general construction of a printer 10 of an embodiment of the present invention.

The embodiments of the present invention are described hereinafter with reference to the accompanying drawings. FIG. 1 shows the general construction of a tandem-type digital color printer (hereinafter referred to simply as "printer") 10 of an embodiment of the present invention.

Figure 2A:
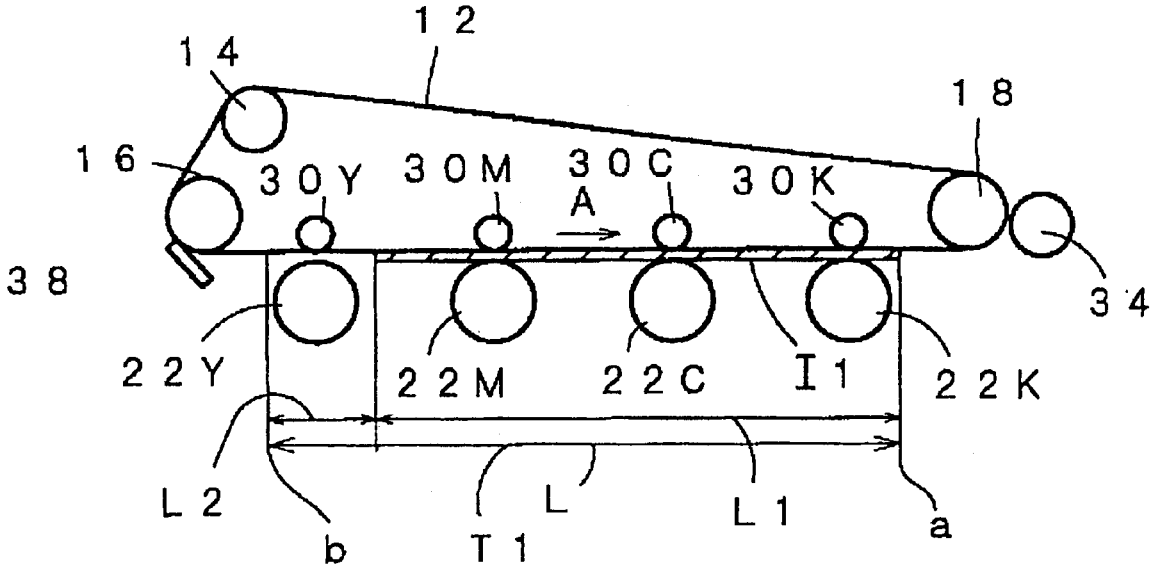
FIG. 2(*a*) shows the state of an image I1 formed on the intermediate transfer belt of FIG. 1.
Figure 2B:
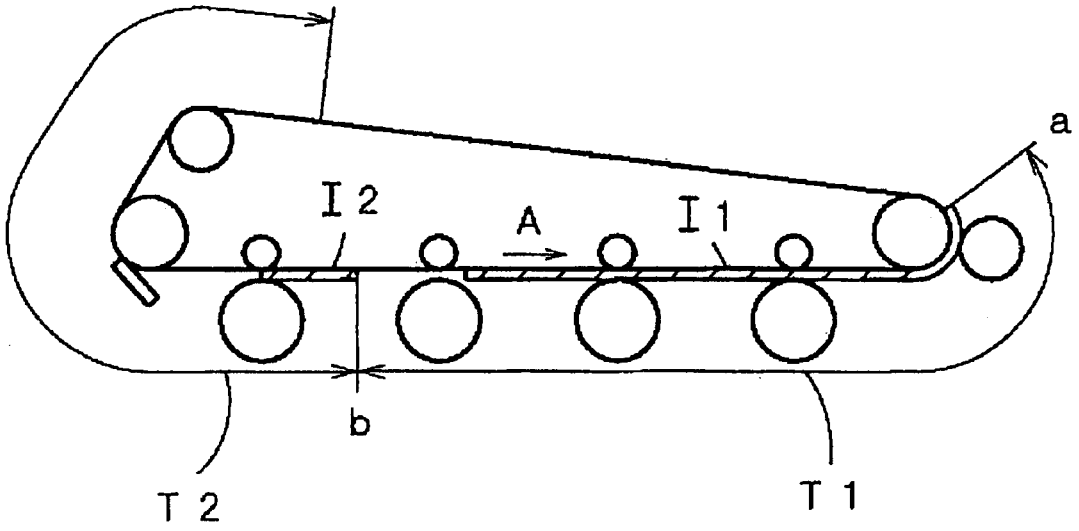

The printer 10 is provided with an intermediate transfer belt 12 arranged in the approximate center of the interior part. The intermediate transfer belt 12 is supported by the exterior surfaces of three rollers 14, 16, 18, and is rotated in the arrow A direction. The length of the intermediate transfer belt 12 is a non-integral integral multiple (the non-integral multiple n is $2<n<3$ in the present embodiment) of a predermined image forming pitch L described later, as shown in FIG. 2(*a*). The intermediate transfer belt 12 is formed by conductive carbon particles dispersed in resin such as polyimide or the like, and has a semi-conductivity with a resistance value of approximately $10^9$ to $10^{11}$ Ω·cm.

Beneath the bottom horizontal part of the intermediate transfer belt 12 are arranged four image forming unit 20Y, 20M, 20C, 20K corresponding to each color yellow (Y), magenta (M), cyan (C), black (K) along the intermediate transfer belt 12.

Each image forming unit 20Y, 20M, 20C, and 20K has a photosensitive drum 22Y, 22M, 22C, 22K, respectively. Arranged around the photosensitive drum 22Y sequentially in the direction of rotation of the drum are a charger 24Y for uniformly charging the surface of the photosensitive drum 22Y, print head 26Y for forming an electrostatic latent image on the surface of the photosensitive drum 22Y by optical exposure corresponding to the image data, developing device 28Y for developing the electrostatic latent image by yellow toner as a toner image, primary transfer roller 30Y for primary transfer of the toner image formed on the surface of the photosensitive drum onto the intermediate transfer belt 12 by electrostatic attraction, and a cleaner 32Y for collecting the residual toner from the surface of the photosensitive drum after the primary transfer. Similarly, arranged sequentially around the periphery of the photosensitive drum 22M in the direction of rotation are charger 24M, print head 26M, developing device 28M develops the electrostatic latent image by magenta toner as a toner image, primary transfer roller 30M, and cleaner 32M, arranged around the periphery of the photosensitive drum 22C are charger 24C, print head 26C, developing device 28C for developing the electrostatic latent image by cyan toner as a toner image, primary transfer roller 30C, and cleaner 32C, and arranged around the periphery of the photosensitive drum 22K are charger 24K, print head 26K, developing device 28K for developing the electrostatic latent image by black toner as a toner image, primary transfer roller 30K, and cleaner 32K. The print heads 26Y, 26M, 26C, and 26K comprise a plurality of LEDs arrayed in the main scan direction parallel to the axial direction of the photosensitive drum.

A secondary transfer roller 34 presses against the part of the intermediate transfer belt 12 supported by the roller 18. The nip area formed between the secondary transfer roller 34 and the intermediate transfer belt comprises the secondary transfer region 36. A transfer voltage is applied to the secondary transfer roller 34. The toner image formed on the intermediate transfer belt 12 is electrostatically attracted to the sheet of the recording medium transported to the secondary transfer region via the transfer voltage as described later.

A cleaner 38 presses against the part of the intermediate transfer belt 12 supported by the roller 16. The cleaner 38 removes the residual toner remaining on the intermediate transfer belt after the secondary transfer, and collects the residual toner in a waste toner hopper 40.

A paper cassette 42 is removably installed in the bottom part of the printer 10. Sheets S stacked in the cassette 42 are fed into the transport path 46 one sheet at a time from the uppermost sheet via the rotation of a take-up roller 44.

The transport path 46 extends from the paper cassette 42 through the nip area formed by the pair of timing rollers 48, secondary transfer region 36, and fixing unit 50 to a discharge tray 11.

A sheet sensor 52 is disposed near the pair of timing rollers 48. The sheet sensor 52 detects the leading edge of a sheet S fed from the cassette 42 into the transport path 46 at the nip area formed by the pair of timing rollers 48. When the leading edge of the sheet S is detected by the sheet sensor 52, the pair of timing rollers 48 temporarily stop rotation, and thereafter the sheet S is transported to the secondary transfer region 36 synchronously with the toner image on the intermediate transfer belt 12.

The fixing unit 50 is provided with a fixing belt 60 supported by a pair of rollers 56 and 58 and rotated in the arrow B direction, and a fixing roller 62 pressed against the roller 56 through the fixing belt 60 and driven in rotation in the arrow direction. A nip area formed by the fixing belt 60 and fixing roller 62 through which passes a sheet bearing the toner image of the secondary transfer comprises a fixing region 64.

The printer 10 is further provided with a controller not shown in the illustrations. Image signals and the like are input to the controller, and signals are output from the controller to the print head LED drive circuit and the like, such that and image is formed at a predermined image forming pitch L on the intermediate transfer belt 12 by the image forming units 20Y, 20M, 20C, 20K as described later. This image forming pitch is determined at a length L matching a maximum sheet size from leading edge to trailing edge, e.g., a sheet length L1 of A3 size, and an image-interval distance L2, as shown in FIG. 2(*a*).

The operation of the printer 10 having the previously described construction is described below.

When an image signal from an external device (e.g., a personal computer) is input to the image signal processor (not shown) in the printer 10, a digital image signal is generated by color conversion of the input image signal to yellow, magenta, cyan, and black by the image signal processor, and this digital image signal is transmitted to the print head LED drive circuit. The drive circuit accomplishes exposure by driving the print heads 26Y, 26M, 26C, 26K to emit light based on the input digital signal. The exposure is accomplished in the sequence of print head 26Y, 26M, 26C, 26K with respective time differential. In this way electrostatic latent images for each color are formed on the surface of the photosensitive drums 22Y, 22M, 22C, 22K, respectively.

The electrostatic latent images formed on the photosensitive drums 22Y, 22M, 22C, 22K are developed by the developing devices 28Y, 28M, 28C, 28K, respectively, to form a toner image of each color. Then, is sequentially overlaid from the leading edge position "a" of the image forming region T1 on the intermediate transfer belt 12 moving in the arrow A direction, and transferred in a primary transfer so as to form a toner image I1 via the operation of the primary transfer rollers 30Y, 30M, 30C, 30K.

In this way the overlaid toner image I1 formed on the intermediate transfer belt 12 reaches the secondary transfer region 36 in conjunction with the movement of the intermediate transfer belt 12. In the secondary transfer belt 12, the overlaid toner image I1 is batch transferred in a secondary transfer onto a sheet S fed from the cassette 42 into the transport path 46 and. transported by the pair of timing rollers 48. Residual toner remaining on the intermediate transfer belt 12 after the secondary transfer is collected by the cleaner 38.

The sheet S bearing the secondary transferred-toner image I1 passes through the transport path 46 to the fixing unit 50, where the toner image I1 is fixed on the sheet S as the sheet S passes through the fixing region 64. Then the sheet S is ejected,to the discharge tray 11.

Figure 3A:
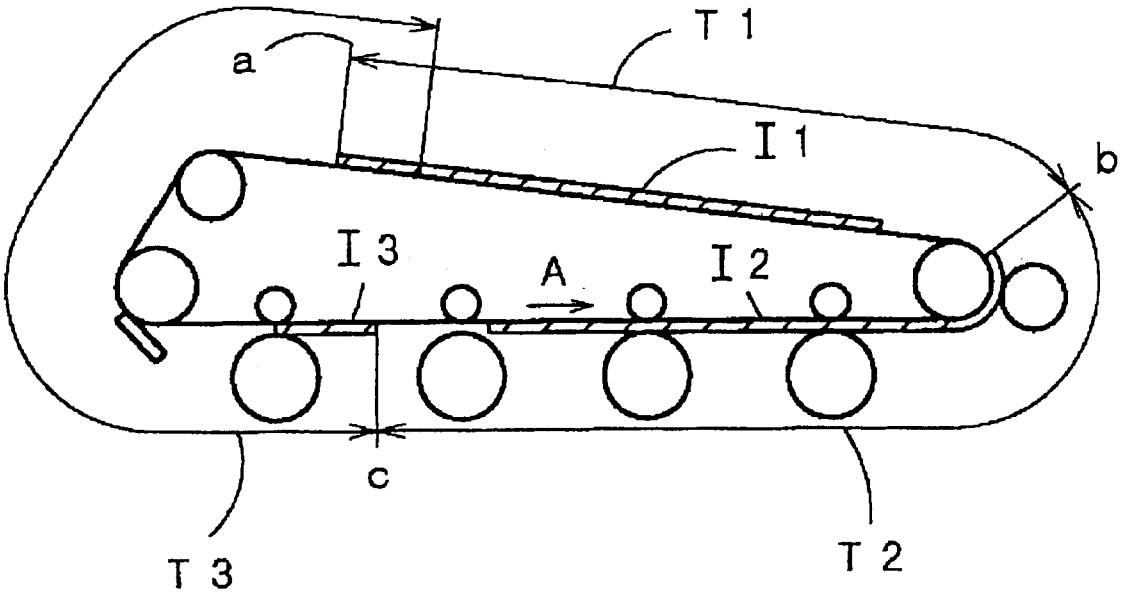
FIG. 3(*a*) shows the state of an image I3 formed on the intermediate transfer belt.
Figure 3B:
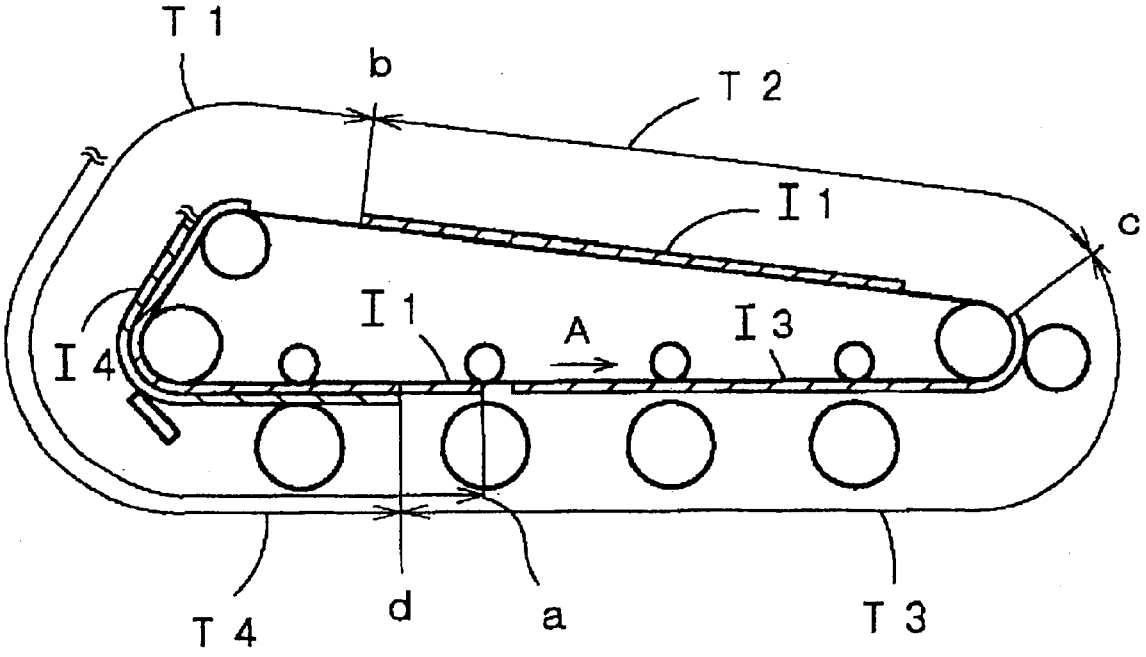

As shown in FIG. 2(*b*), after the toner image I1 is formed, a toner image I2 is formed from the leading edge position "b" of an image forming region T2 positioned on the downstream side of the leading edge position "a" at an image forming pitch L in the direction of movement of the intermediate transfer belt 12. Then, as shown in FIG. 3(*a*), a toner image I3 is formed from the leading edge position "c" of an image forming region T3 positioned on the downstream side of the leading edge position "b" at an image forming pitch L.

Since the length of the intermediate transfer belt 12 is a non-integral multiple of the image forming pitch L, the leading edge position "d" of the image forming region T4 for forming a toner image T4 is positioned on the downstream side from the leading edge position "a" and does not match the leading edge position "a" for forming the toner image T1. The image forming region T4 for forming the toner image T4 is shifted to the downstream side in the direction of movement of the intermediate transfer belt 12 and does not match the image forming region T1. In this way the image forming regions are gradually shifted to the downstream side each completed rotation of the intermediate transfer belt 12. Therefore, the image forming regions can be dispersed on the surface of the intermediate transfer belt 12, and the parts of the intermediate transfer belt 12 subject to a change-of-state due to the multiple and repeated formation of images in the same region on the intermediate transfer belt 12, e.g., parts of the intermediate transfer belt 12 subject to changed resistance value caused by changes in the state of dispersion of carbon particles contained in the intermediate transfer belt 12, and parts of the intermediate transfer belt 12 subject to changed surface state, can be dispersed to as to prevent image drift and degrading of image quality, and produce excellent images.

Furthermore, the distance from the primary transfer position of the image forming unit K to the secondary transfer position can be reduced by positioning the image forming units 20Y, 20M, 20C, and 20K below the intermediate transfer belt. Therefore, the speed of the first image formation can be increased, toner waste is reduced because few toner images are formed on the intermediate transfer belt when the image forming operation is interrupted due to paper jam and the like, and the distance from the secondary transfer position to the fixing device can be easily reduced, which is advantageous relative to small size sheets such as postcards and the like.

Although the intermediate transfer belt has been described in terms of a belt in the present embodiment, various other forms may be used, such as, for example, a drum.

In the present embodiment, the image forming units are arranged below the intermediate transfer belt, but the image forming units also may be arranged, for example, above the intermediate transfer belt.

A printer has been described as an example in the present embodiment, but the present invention is also applicable to other types of image forming apparatuses, including copiers, facsimiles, and multipurpose machines combining a printer and these other devices.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. A color image forming apparatus comprising:

an intermediate transfer belt having a movable surface;

a first image forming unit for forming a first toner image of a first color on the intermediate transfer belt at a predetermined image forming pitch;

a second image forming unit for forming a second toner image of a second color to superimpose on the first toner image formed on the intermediate transfer belt at the predetermined image forming pitch, the second image forming unit being disposed downstream of the first image forming unit with respect to the surface-moving direction of the intermediate transfer belt;

a third image forming unit for forming a third toner image of a third color to superimpose on the first and the second toner images formed on the intermediate transfer belt at the predetermined image forming pitch, the third image forming unit being disposed downstream of the second image forming unit with respect to the surface-moving direction of the intermediate transfer belt;

a fourth image forming unit for forming a fourth toner image of a fourth color to superimpose on the first, the second and the third toner images formed on the intermediate transfer belt at the predetermined image forming pitch, the fourth image forming unit being disposed downstream of the third image forming unit with respect to the surface-moving direction of the intermediate transfer belt; and a transfer roller for transferring the superimposed toner images formed on the intermediate transfer belt onto a sheet of paper;

wherein the peripheral length of the intermediate transfer belt is a non-integral multiple of the image forming pitch.

2. The color image forming apparatus of claim 1, wherein the intermediate transfer belt has a resistance value of $10^9$ to $10^{11}$ Ω·cm.

3. The color image forming apparatus of claim 1, wherein the peripheral length of the intermediate transfer belt is the non-integral multiple n of the image forming pitch, the non-integral multiple n is $2<n<3$.

4. The color image forming apparatus of claim 1,. wherein the image forming pitch is a total length of a paper length and an image interval distance.

5. The color image forming apparatus of claim 4, wherein the paper length is a maximum paper length of usable papers.

6. The color image forming apparatus of claim 1, wherein the first image forming unit, the second image forming unit, the third image forming unit and the fourth image forming unit are disposed on a lower side of the intermediate transfer belt.

7. The color image forming apparatus of claim 6, wherein the intermediate transfer belt is supported by a plural rollers including a first roller and a second roller, the transfer roller being disposed so as to press against the part of the intermediate transfer belt supported by the first roller, the second roller being located at the opposite side of the first roller, a cleaner being disposed so as to press against the part of the intermediate transfer belt supported by the second roller.

8. The color image forming apparatus of claim 7, wherein the plural rollers includes the first roller, the second roller and a third roller which is located downstream of the first roller with respect to the surface-moving direction of the intermediate transfer belt and is located upstream of the second roller with respect to the surface-moving direction of the intermediate transfer belt.

9. The color image forming apparatus of claim 7, wherein the first image forming unit, the second image forming unit, the third image forming unit and the fourth image forming unit are disposed on a lower side of the intermediate transfer belt between the first roller and the second roller, the first through the fourth image forming units being located downstream of the second roller with respect to the surface-moving direction of the intermediate transfer belt and located upstream of the first roller with respect to the surface-moving direction of the intermediate transfer belt.

10. The color image forming apparatus of claim 7, comprising:

a paper feeding device being disposed on a lower side of the first through the fourth image forming units; and a pair of timing rollers for feeding the paper fed from the paper feeding device to a nip portion between the transfer roller and the first roller in synchronism with the superimposed toner images on the intermediate transfer belt, the pair of timing rollers being disposed on a lower side of the nip portion.

11. The color image forming apparatus of claim 10, comprising a fixing unit for fixing the superimposed toner images transferred on the paper by the transfer roller, the fixing unit being disposed on an upper side of the nip portion between the transfer roller and the first roller.

12. A color image forming apparatus comprising:

an intermediate transfer member having a movable surface;

a plural image forming units for forming superposed toner images on the intermediate transfer member at a predetermined image forming pitch; and a transfer member for transferring the superposed toner images formed on the intermediate transfer member onto a sheet of paper;

wherein the peripheral length of the intermediate transfer member is a non-integral multiple of the image forming pitch.

13. The color image forming apparatus of claim 12, wherein the intermediate transfer member has a resistance value of $10^9$ to $10^{11}$ Ω·cm.

14. The color image forming apparatus of claim 12, wherein the peripheral length of the intermediate transfer member is the non-integral multiple n of the image forming pitch, the non-integral multiple n is $2<n<3$.

15. The color image forming apparatus of claim 12, wherein the image forming pitch is a total length of a paper length and an image interval distance.

16. The color image forming apparatus of claim 15, wherein the paper length is a maximum paper length of usable papers.

17. The color image forming apparatus of claim 12, wherein the intermediate transfer member is an intermediate transfer belt, the transfer member is a transfer roller, and the plural image forming units are disposed on a lower side of the intermediate transfer belt.

18. The color image forming apparatus of claim 17, wherein the intermediate transfer belt is supported by a plural rollers including a first roller and a second roller, the transfer roller being disposed so as to press against the part of the intermediate transfer belt supported by the first roller, the second roller being located at the opposite side of the first roller, a cleaner being disposed so as to press against the part of the intermediate transfer belt supported by the second roller.

19. The color image forming apparatus of claim 18, wherein the first through the fourth image forming units are disposed on a lower side of the intermediate transfer belt between the first roller and the second roller, the first through the fourth image forming units being located downstream of the second roller with respect to the surface-moving direction of the intermediate transfer belt and located upstream of the first roller with respect to the surface-moving direction of the intermediate transfer belt.

20. The color image forming apparatus of claim 18, comprising:

a paper feeding device being disposed on a lower side of the first through the fourth image forming units;

a pair of timing rollers for feeding the paper fed from the paper feeding device to a nip portion between the transfer roller and the first roller in synchronism with the superimposed toner images on the intermediate transfer belt, the pair of timing rollers being disposed on a lower side of the nip portion; and a fixing unit for fixing the superimposed toner images transferred on the paper by the transfer roller, the fixing unit being disposed on an upper side of the nip portion between the transfer roller and the first roller.

* * * * *